US006911907B2

(12) United States Patent
Kelliher et al.

(10) Patent No.: US 6,911,907 B2
(45) Date of Patent: Jun. 28, 2005

(54) SYSTEM AND METHOD OF PROVIDING SECURITY FOR A SITE

(75) Inventors: Timothy Patrick Kelliher, Scotia, NY (US); Jens Rittscher, Schenectady, NY (US); Peter Henry Tu, Schenectady, NY (US); Douglas H. Marman, Ridgefield, WA (US)

(73) Assignee: General Electric Company, Niskayuna, NY (US)

( * ) Notice: Subject to any disclaimer, the term of this patent is extended or adjusted under 35 U.S.C. 154(b) by 98 days.

(21) Appl. No.: 10/672,632

(22) Filed: Sep. 26, 2003

(65) Prior Publication Data

US 2005/0068165 A1 Mar. 31, 2005

(51) Int. Cl.[7] ..... G08B 19/00

(52) U.S. Cl. ..... 340/522; 340/5.1; 340/5.2; 340/5.52; 340/5.53; 340/5.8; 340/5.81; 340/5.82; 340/5.83

(58) Field of Search ..... 340/522, 3.3, 3.31, 340/3.32, 5.11, 5.2, 5.52, 5.53, 5.8, 5.81, 5.82, 5.83

(56) References Cited

U.S. PATENT DOCUMENTS

| | | | | | |
|---|---|---|---|---|---|
| 5,715,178 | A | * | 2/1998 | Scarola et al. | 702/116 |
| 6,072,891 | A | * | 6/2000 | Hamid et al. | 382/116 |
| 6,193,153 | B1 | * | 2/2001 | Lambert | 235/380 |
| 6,301,375 | B1 | * | 10/2001 | Choi | 382/115 |
| 6,320,974 | B1 | * | 11/2001 | Glaze et al. | 382/115 |
| 6,624,739 | B1 | * | 9/2003 | Stobbe | 340/5.2 |
| 6,719,200 | B1 | * | 4/2004 | Wiebe | 235/382 |

OTHER PUBLICATIONS

Matthew A Turk, et al. "Face Recognition Using Eigenfaces"; Vision and Modeling Group, The Media Laboratory; Massachusetts Institute of Technology; 1991; pp. 586–591.

Peter Tu, et al. "Statistcal Significance as an Aid to System Performance Evaluation"; Image Understanding Group; General Electric; pp. 1–12.

* cited by examiner

*Primary Examiner*—Daryl C Pope
(74) *Attorney, Agent, or Firm*—Fletcher Yoder

(57) ABSTRACT

A system and method capture a comprehensive biometric profile, (e.g., height, build, and appearance) through non-intrusive identification and tracking throughout a site.

22 Claims, 2 Drawing Sheets

SYSTEM AND METHOD OF PROVIDING SECURITY FOR A SITE

BACKGROUND OF THE INVENTION

1. Field of the Invention

The present disclosure generally relates to providing security for a site. In particular, the present disclosure relates to non-intrusive identification and tracking of individuals throughout a site.

2. Description of the Related Art

There is a growing need for security in our world. As a result, buildings that were once open to the public are now restricted to authorized personnel. Offices, shopping malls, airports, and other public places need to track individuals while they are on site. Offices often have badges and sometimes have fingerprint readers for employee access. Shopkeepers in malls have closed circuit television cameras to detect shoplifting of merchandise. Airports restrict access to authorized personnel beyond certain checkpoints, while other areas are open to the public. For example, an airline employee gains access when his badge is seen by a security guard at a checkpoint and passengers gain access to a plane after stopping and handing a boarding pass to a clerk at another checkpoint.

Checkpoints are used in many environments to control access in specific areas. Initial checkpoints often are the only formal security check. Most checkpoints are located at the periphery of the controlled area, like walls guarding a fort, a moat around a castle, or customs personnel at the border. However, this leads to poor security performance. Once an unauthorized person or object gains access into the controlled area past a checkpoint, by deception, by not being detected, by climbing a wall, or by slipping in through a backdoor, the person typically is not interrogated by any other security system. The most common reason checkpoints let unauthorized personnel into the controlled area is that they rely on human judgment.

Biometrics is sometimes used at an initial checkpoint. Biometrics is the science and technology of measuring and statistically analyzing biological data. In information technology, biometrics usually refers to technologies for measuring and analyzing human body characteristics such as fingerprints, eye retinas and irises, voice patterns, facial patterns, and hand measurements, especially for authentication purposes. Fingerprint identification and iris scanning are intrusive, create long lines, require a pre-established database, and are not easily used within a controlled area. Also, they are only used for tracking humans, not objects. Some biometric systems tend to be focused on a particular method to the exclusion of other methods. Face scans are limited in their ability to work if a camera is in the wrong position or in a position different from an original position.

There is a need for a non-intrusive way to identify individuals so that they do not have to carry anything and do not have to stop and do something at a checkpoint. After an initial checkpoint, there is a need for tracking individuals throughout a site. For example, when someone walks out of a controlled area into somewhere without a tracking device, such as a washroom and then walks back into the controlled area, their identity needs to be re-established. There is a need for predicting events at later checkpoints based on events at earlier checkpoints. There is a need for a system accommodating new and different types of sensors. There is a need for automating various tasks of security guards to increase their productivity.

SUMMARY OF THE INVENTION

The present disclosure is directed to systems and methods of providing security for a site that satisfies one or more of these needs.

One version is a system for providing security, which comprises at least two sensors, a third sensor, and at least one computing device. At a first position, the first two sensors capture a first sensed data about an individual. At a second position, the third sensor captures a second sensed data about the individual. The computing device establishes the identity of the individual by comparing the first and second sensed data. In one embodiment, the system also comprises a statistical model to generate a confidence measure used in establishing the identity of the individual. In another embodiment, the computing device generates profile information for the individual at the first position and generates predicted information for the individual at the second position based at least in part on the profile information. In another embodiment, the computing device compares the predicted information to the second sensed data to establish the identity of the individual. In another embodiment, the first two sensors are non-intrusive sensors.

Another version is a method for providing security. At a first position, at least two sensors capture a first sensed data about an individual. A profile is generated based on the first sensed data and the identity of the individual is established. Predicted information is generated based on the profile. At a second position, at least a third sensor captures a second sensed data about the individual. Then, the predicted information is compared with the second sensed data. In one embodiment, the identity is established within a confidence threshold. In another embodiment, an alert is produced when the identity is not confirmed by the comparing step. In another embodiment, the two sensors are non-intrusive sensors. In another embodiment, the non-intrusive sensors are cameras. In another embodiment, the profile is a 3D model. In another embodiment, the identity is established at least in part by a facial recognition system.

Another version is a computer readable medium having instructions for performing a method for providing security. At a first position where an object is within range, a sensor data is captured non-intrusively. A profile is generated based on the sensor data. An attempt is made to identify the object within a confidence threshold. At a second position, the profile and sensor data is used to attempt to identify the object. In one embodiment, the object is an individual. In another embodiment, the object is a piece of equipment. In another embodiment, an event is identified and associated with the object. In another embodiment, an alert is produced about the event. In another embodiment, at a second position, a second object is identified that was not identified at the first position. In another embodiment, the sensor data is captured by at least one camera. In another embodiment, the camera is part of a distributed camera network. In another embodiment, views are automatically generated for a face recognition system. In another embodiment, security effectiveness is tested by equipping known objects with location tracking devices.

BRIEF DESCRIPTION OF THE DRAWINGS

These and other features, aspects, and advantages of the present disclosure will become better understood with reference to the following description, appended claims, and drawings where:

DETAILED DESCRIPTION OF THE PREFERRED EMBODIMENTS

Figure 1:
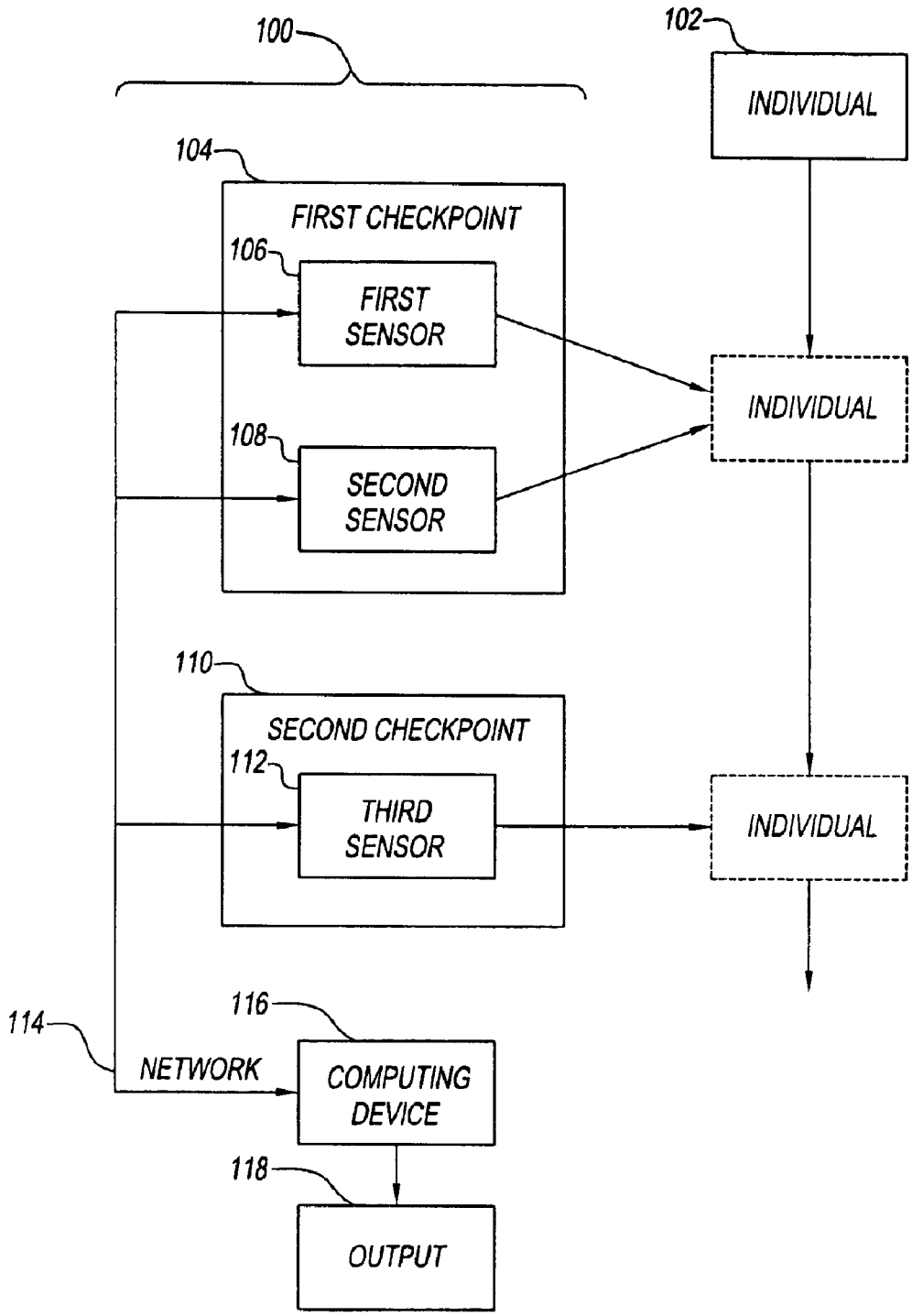
FIG. 1 is a block diagram of an example system for providing security for a site.

FIG. 1 shows an example system 100 of providing security for a site. When an individual 102 is within range of a first checkpoint 104, information is captured about the identity of individual 102 by a first sensor 106 and a second sensor 108. An identity is who individual 102 is, such as a particular employee, a general identity such as an intruder, or a collection of profile information. When individual 102 is within range of a second checkpoint 110, additional information is captured about the identity of individual 102 by a third sensor 112. First sensor 106, second sensor 108, and third sensor 112 communicate via a network 114 with a computing device 116, which produces output 118.

First checkpoint 104 and second checkpoint 110 are locations in a site where information is captured about the identity of individual 102. For example, first checkpoint 104 is located near an entrance to a stadium and checkpoint 110 is located near a backdoor to the stadium. System 100 may contain additional checkpoints. First checkpoint 104 and second checkpoint 110 may be located anywhere in or around the stadium and may contain additional sensors.

First sensor 106, second sensor 108, and third sensor 112 are any type of sensor and may all be the same type or different types. First sensor 106, second sensor 108, and third sensor 112 may be active or passive. An active sensor sends, receives, and processes information while a passive sensor only receives information. First sensor 106, second sensor 108, and third sensor 112 may be biometric or quasi-biometric. A biometric sensors measures and analyzes human body characteristics. A quasi-biometric sensor has some degree of biometrics in combination with other types of sensors. Examples of biometric sensors include fingerprints, eye retinas and irises, voice patterns, facial patterns, and hand measurements. Other examples of sensors include heart rhythm detectors, biological detectors, and thermal scanners. System 100 may employ other kinds of sensors and incorporate new sensors. Preferably, first sensor 106, second sensor 108, and third sensor 112 are minimally intrusive or non-intrusive on individual 102. Depending on the site, more intrusive or active sensors such as fingerprint scanners may be used for first sensor 106, second sensor 108, and third sensor 112. The system may also employ the use of structured light or other environmental effects to aid the sensors. A distributed network of cameras is employed in one embodiment.

Network 114 is any kind of network, such as wireless or Ethernet. First sensor 106, second sensor 108, and third sensor 112 communicate with computing device 116 over network 114.

Computing device 116 is any kind of device having a processor, such as a personal computer or a server. System 100 has one or more computing device 116. Various configurations of computing device 116 and first sensor 106, second sensor 108, and third sensor 112 are possible to distribute processing power. In a centralized example, computing device 116 retrieves all captured information from first sensor 106, second sensor 108, and third sensor 112 for processing. In a distributed example, first sensor 106, second sensor 108, and third sensor 112 include processors and software components for pre-processing captured information before sending it to computing device 116 for additional processing.

Computing device 116 has software components for processing captured information and performing tasks of system 100. Many different kinds of software components may be used, such as software to convert captured information into digital form, data analysis tools, and database management. Some examples include image capture, 3D graphics tools, comparison engines, face recognition software, and database indexing capability. Indexing capability is the ability to query the database for identity information.

Output 118 is produced by computing device 116 as a result of operating system 100. For example, individual 102 enters the stadium and comes within range of first checkpoint 104. First sensor 106 and second sensor 108 are cameras that capture image information about individual 102 and send the image information over network 114 to computing device 116. Computing device 116 processes the image information to establish the identity of individual 102 and generates a profile of individual 102. The identity and profile of individual 102 are examples of output 118. The profile is a collection of information about individual 102, such as height, build, and appearance. Then, computing device 116 generates prediction information to predict what individual 102 will look like when individual 102 is within range of second checkpoint 110. If first sensor 106 is calibrated to capture an image of individual 102 from a top view, second sensor 108 is calibrated to capture an image of individual 102 from a side view, and third sensor 112 is calibrated to capture an image of individual 102 from a front view, computing device 116 predicts a front view for third sensor 112 by manipulating the images in the profile. Computing device 116 may also use additional information for such predictions, such as a database of characteristics of various populations of people.

Another example of output 118 is an alert for a security guard. Suppose second checkpoint 110 is located near the backdoor of the stadium. At second checkpoint 110, system 100 detects an intruder that did not pass first checkpoint 104 at the stadium entrance. Computing device 116 determines that the intruder did not pass first checkpoint 104 by comparing image information about the intruder captured by third sensor 112 to image information in a profile and predicted information stored in a database of individuals 102 that passed first checkpoint 104. Then, computing device 116 produces the alert. Furthermore, system 100 takes other actions, such as increasing surveillance by tracking individual 102 at every checkpoint throughout the site. Additional output 118 may also be provided, such as stored images from additional sensors tracking the intruder from outside the site through the backdoor to second checkpoint 110.

Figure 2:
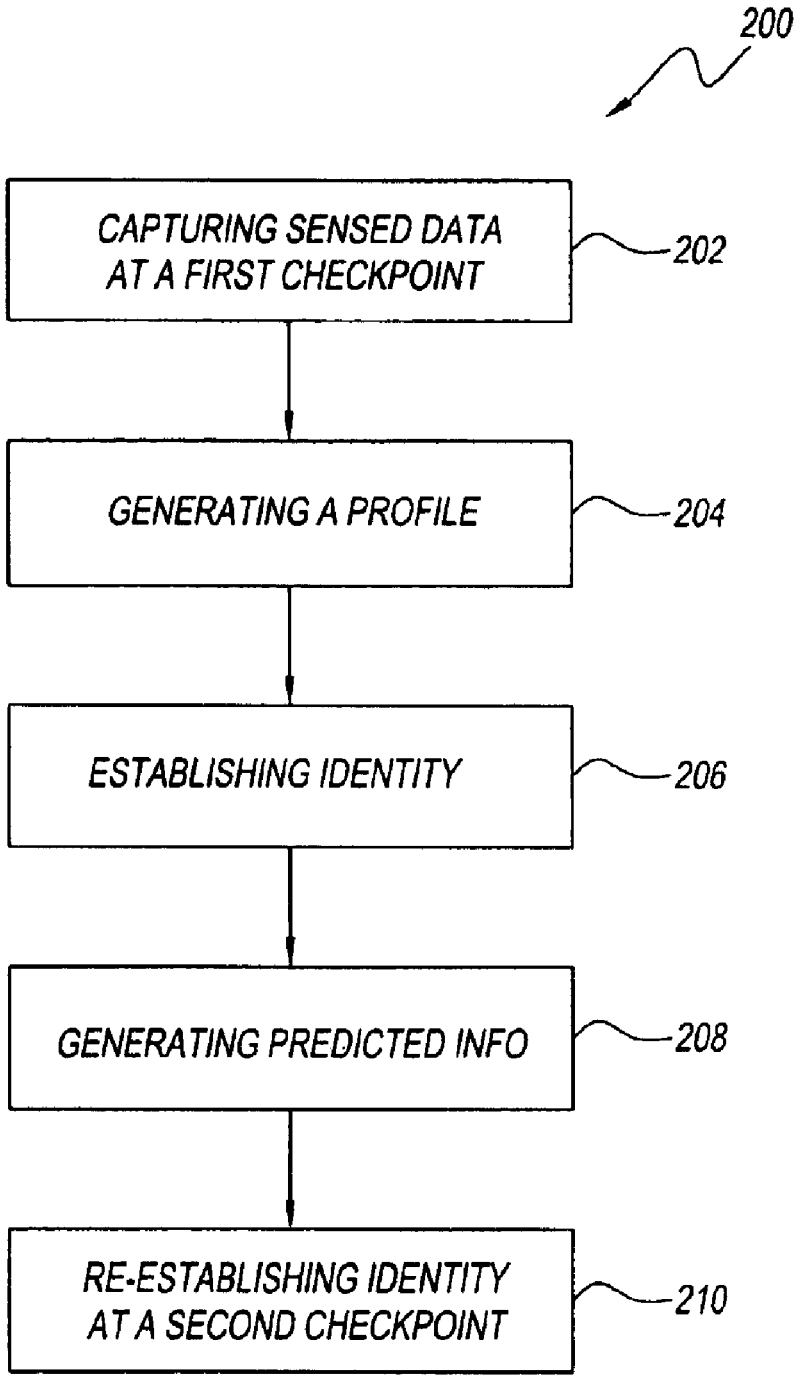
FIG. 2 is a flow diagram of an example method for providing security for a site.

FIG. 2 shows an example method 200 for providing security for a site, which may be used to operate the example system 100 of FIG. 1. In step 202, first sensor 106 and second sensor 108 at first checkpoint 104 capture information about individual 102. In step 204, computing device 116 generates a profile. In step 206, computing device 116 establishes the identity of individual 102. In step 208, computing device 116 generates predicted information for use at second checkpoint 110. In step 210, computing device 116 re-establishes the identity of individual 102 at second checkpoint 110.

An example of step 202 is where first checkpoint 104 is located at the entrance of the stadium. First sensor 106 and second sensor 108 are cameras that capture multiple images of individual 102 and send the images to computing device 116.

An example of step 204 is where computing device 116 generates a facial profile of individual 102 based on the captured images.

An example of step 206 is where computing device 116 searches an employee database for information matching the facial profile and establishes that individual 102 is a particular employee with confidence measure of 80%, which meets a predetermined confidence threshold. Generally, confidence measures are statistical estimates of the certainty of a particular result in a population. The confidence measure may also be a lack of confidence, such as when the intruder is detected at second checkpoint 110. In an alternate embodiment, first sensor 106 and second sensor 108 captured biometric information. In this case, computing device 116 reduces the biometric information into a set of parameters to compare against stored templates in a process called template matching.

An example of step 208 is where computing device 116 uses the facial profile to generate predicted information. The predicted information is the images likely to be captured by third sensor 112.

An example of step 210 is where second checkpoint 110 is located near a concession stand and third sensor 112 is a laser scanner. Third sensor 112 performs a full 3D scan as well as direct scans of the ear, the eye, and the face of individual 102, while individual 102 is waiting in line. From this full 3D scan, computing device 116 generates a set of 3D structures, a general structure of individual 102, and a model for creating future predictions. Computing device 116 automatically generates and sends views to a face recognition system. Information returned to computing device 116 from the face recognition system is used to re-establish the identity of individual 102. At a later checkpoint, computing device 116 extracts a particular representation of the ear from the model and compares it to a new scan of the ear to re-establish the identity of individual 102.

Another example of step 210 is where third sensor 112 is a camera in a hallway with an oblique view of individual 102. Since the face of individual 102 is not readily captured, third sensor 112 captures the height of individual 102. Computing device 116 compares predicted information generated in step 208 with the profile generated in step 204 and a statistical model containing height distribution across the general population to attempt to identify individual 102. If computing device 116 knows that there is only one person on the site who is supposed to be on the site and he is six foot five inches tall, then computing device 116 has increased confidence that individual 102 with that height has access. On the other hand, if individual 102 is in the middle of a range of average height, then computing device 116 has decreased confidence that individual 102 has access. Computing device 116 changes the confidence threshold to be based on who is currently on the site rather than on the total population. As individual 102 passes various additional sensors at additional checkpoints, eventually enough information is accumulated so that system 100 can identify individual 102. At each checkpoint, system 100 provides the best information so far for identification purposes. In addition, system 100 uses predicted information to increase efficiency by reducing computation and sensor activity. For example, computing device 116 uses a search only for establishing or re-establishing an identity. Thus, even without universal coverage for a site, identification and tracking may be done confidently.

Testing is conducted for some embodiments by equipping known individuals with location tracking devices, such as global positioning systems (GPS) or an indoor equivalent and determining if system 100 tracks them throughout the site.

Similar systems and methods are used for identifying objects, such as equipment as used for identifying individuals. Additionally, events associated with establishing the identity of individual 102 are processed by system 100, in some embodiments. For example, one event is the initial identification of individual 102 at first checkpoint 104. Another event is detecting an intruder and so on.

It is to be understood that the above description is intended to be illustrative and not restrictive. Many other embodiments will be apparent to those of skill in the art upon reviewing the above description, such as adaptations of the present disclosure to homes, warehouses, buildings, sports arenas, country borders and any other areas that need security. Various types of hardware and software are contemplated by the present disclosure, even though some minor elements would need to change to better support the environments common to such systems and methods. The present disclosure has applicability to fields outside offices, shopping malls, and airports, such as home security and other kinds of security. Therefore, the scope of the present disclosure should be determined with reference to the appended claims, along with the full scope of equivalents to which such claims are entitled.

What is claimed is:

1. A method for providing security, which comprises:

capturing a first sensed data about an individual from at least two sensors at a first position;

generating a profile based on said first sensed data;

establishing an identity of said individual;

generating predicted information based on said profile;

capturing a second sensed data about said individual from at least a third sensor at a second position; and comparing said predicted information with said second sensed data.

2. The method according to claim 1, further comprising:

establishing said identity within a confidence threshold.

3. The method according to claim 1, further comprising:

producing an alert when said identity is not confirmed by said comparing step.

4. The method according to claim 1, wherein said at least two sensors are non-intrusive sensors.

5. The method according to claim 4, wherein said non-intrusive sensors are cameras.

6. The method according to claim 5, wherein said profile is a 3D model.

7. The method according to claim 4, wherein said establishing said identity is performed at least in part by a facial recognition system.

8. A system for providing security, which comprises:

at least two sensors at a first position for capturing a first sensed data about an individual;

a third sensor at a second position for capturing a second sensed data about said individual; and at least one computing device to establish an identity of said individual by comparing said first sensed data and said second sensed data.

9. The system according to claim 8, further comprising a statistical model to generate a confidence measure used in establishing said identity of said individual.

10. The system according to claim 8, wherein said at least one computing device generates profile information for said individual at said first position and generates predicted information for said individual at said second position based at least in part on said profile information.

11. The system according to claim 10, wherein said at least one computing device compares said predicted information to said second sensed data to establish said identity of said individual.

12. The system according to claim 8, wherein said at least two sensors are non-intrusive sensors.

13. A computer readable medium having instructions for performing a method for providing security, said method comprising:

capturing a sensor data non-intrusively at a first position where an object is within range;

generating a profile based on said sensor data;

attempting to identify said object within a confidence threshold; and using said profile and said sensor data at a second position to attempt to identify said object.

14. The computer readable medium according to claim 13, wherein said object is an individual.

15. The computer readable medium according to claim 13, wherein said object is a piece of equipment.

16. The computer readable medium according to claim 13, further comprising:

identifying an event and associating said object.

17. The computer readable medium according to claim 16, further comprising:

producing an alert about said event.

18. The computer readable medium according to claim 13, further comprising:

identifying, at said second position, a second object that was not identified at said first position.

19. The computer readable medium according to claim 13, wherein said sensor data is captured by at least one camera.

20. The computer readable medium according to claim 19, wherein said at least one camera is part of a distributed camera network.

21. The computer readable medium according to claim 19, further comprising:

automatically generating views for a face recognition system.

22. The computer readable medium according to claim 19, further comprising:

testing security effectiveness by equipping known objects with location tracking devices.

* * * * *